US005569169A

United States Patent [19]

Lewark, Sr.

[11] Patent Number: 5,569,169

[45] Date of Patent: Oct. 29, 1996

[54] AUTO MASSAGE APPARATUS AND METHOD

[76] Inventor: Maylon J. Lewark, Sr., 756 Hillwell Rd., Chesapeake, Va. 23320

[21] Appl. No.: 267,248

[22] Filed: Jun. 29, 1994

[51] Int. Cl.[6] ..... A61H 11/00

[52] U.S. Cl. ..... 601/134; 606/204

[58] Field of Search ..... 601/134–137, 601/143–147, 118, 120, 124; 606/204, 201; 128/898

[56] References Cited

U.S. PATENT DOCUMENTS

| | | | |
|---|---|---|---|
| 781,683 | 2/1905 | Shepherd | 601/143 |
| 859,507 | 7/1907 | Murdoch | 601/137 |
| 892,341 | 6/1908 | Weintraud | 601/136 |
| 932,780 | 8/1909 | Hero | 601/120 |
| 1,106,493 | 8/1914 | Catlin | 601/143 |
| 1,473,315 | 11/1923 | Poirier | 601/143 |
| 1,560,549 | 11/1925 | Duncan | 601/120 |
| 2,280,274 | 4/1942 | Wildermuth . | |
| 2,716,027 | 8/1955 | Gehri | 272/83 |
| 3,672,358 | 6/1972 | Majewski | 601/132 |
| 4,492,373 | 1/1985 | Dzitzer | 272/61 |
| 4,531,514 | 7/1985 | McDonald et al. . | |
| 4,606,539 | 8/1986 | Farnham | 272/93 |
| 5,143,057 | 9/1992 | DePasquale . | |
| 5,176,602 | 1/1993 | Roberts | 482/131 |
| 5,209,712 | 5/1993 | Ferri | 482/91 |

FOREIGN PATENT DOCUMENTS

| | | | |
|---|---|---|---|
| 26682 | of 1912 | United Kingdom | 601/132 |

OTHER PUBLICATIONS

"Original Backnobbers" from The Pressure Positive Company Gilbertsville, PA 19525.

Thera–Cane for Deep Pressure Massage Owner's Manual.

*Primary Examiner*—Robert A. Hafer

*Assistant Examiner*—Brian E. Hanlon

*Attorney, Agent, or Firm*—Griffin, Butler Whisenhunt & Kurtossy

[57] ABSTRACT

A flexible strand is provided with pressure applying nodules spaced therealong so that the strand may be looped around various deeper body muscle groups to apply pressure to the muscle groups and relieve muscle pain. An optional bar may be also used, either by itself, or with the flexible strand, to apply pressure to muscles which are close to the surface of the body.

3 Claims, 4 Drawing Sheets

AUTO MASSAGE APPARATUS AND METHOD

FIELD OF THE INVENTION

This invention relates to apparatus and method for massage therapy; more particularly, the invention relates to an apparatus and method for self, or auto, applying to various muscle groups on the body, pain relieving pressure to both surface and deep muscle tissues.

BACKGROUND AND OBJECTS OF THE INVENTION

There are many physical conditions which result in muscle pain or significant immotility. Therapy for these conditions, to relieve pain and provide symptomatic relief, usually comprises the application of pressure, as for example, by the hands of a therapist, or electrical stimulation of muscle tissues. In general, while these methods have their advantages, when chronic conditions arise which make frequent therapy sessions desirable, where either the therapist or equipment is not available or becomes too expensive, a different solution is needed. To the extent possible, the therapeutic administration of pressure to affected muscle or muscle groups then has to be performed by the patient itself.

Accordingly, it is a primary object of this invention to provide a method and apparatus which allows self, or auto, muscle pressure therapy at any desired time by the patient itself.

Devices for the auto-application of pressure to selected muscles or muscle groups are known. In general, these devices consist of massage tools made of steel, fiberglass or other rigid materials, with at least one or more protrusions which, when located above a muscle or muscle group, are used to apply pressure to localized areas of the body.

These devices of the prior art have a number of deficiencies, including awkwardness of use and limited coverage of the muscle tissue in selected body areas. Thus, for example, fiberglass or steel devices formed in various shapes with at least one, if not more, knobs protruding therefrom, sometimes have to be used in awkward configurations and depend significantly on the strength of arm muscles for the application of pressure. Since persons affected by muscular disabilities or syndromes have generally weaker arm muscles, than, say, leg muscles, the efficacy of the therapy is diminished.

Accordingly it is another object of the invention to provide auto massage apparatus and method which relies more heavily on the use of leg muscles for the application of therapeutic pressure to affected muscles or muscle groups.

Another deficiency of the prior art devices, because of their generally awkward multifaceted configurations, is that such devices are not easily portable to allow a user to transport the device on trips out of town, such as for business or pleasure purposes.

Accordingly it is another object of this invention to provide auto massage apparatus and method which can easily accompany a patient because of its ease of transportability.

SUMMARY OF THE INVENTION

In accordance with one aspect of the invention, a flexible, but inextensible, carrier, for example a nylon rope, is equipped with a series of pressure applying nodules which may preferably, but not necessarily, be formed by knots in the rope. One end of the apparatus has secured thereto a fastening loop so that an attachment device, cooperating with the attachment loop, can be used to anchor one part of the apparatus to a fixed support, for example, a door jamb.

At the end of the apparatus opposite the attachment loop, the flexible device is adapted to cooperate with a rigid bar made, for example, of wood. The wooden bar may be attached to the flexible therapeutic device through apertures in the bar through which the flexible apparatus can be looped for easy connection or disconnection of the bar from the therapeutic apparatus.

In accordance with another aspect of the invention, the bar, which may be used with the flexible therapeutic apparatus, may also be used by itself to apply localized pressure to various parts of the body, including an embodiment in which the bar, which is normally provided with smooth, pressure distributing rubber tips at both ends thereof, may also be equipped, at either, or both ends thereof with weights designed to augment the pressure applying capability of the bar to selected muscle groups.

The foregoing features, objects, and advantages of the invention will be apparent from the following more particular description of several preferred embodiments thereof, as illustrated in the accompanying drawings.

DETAILED DESCRIPTION

Figure 1:
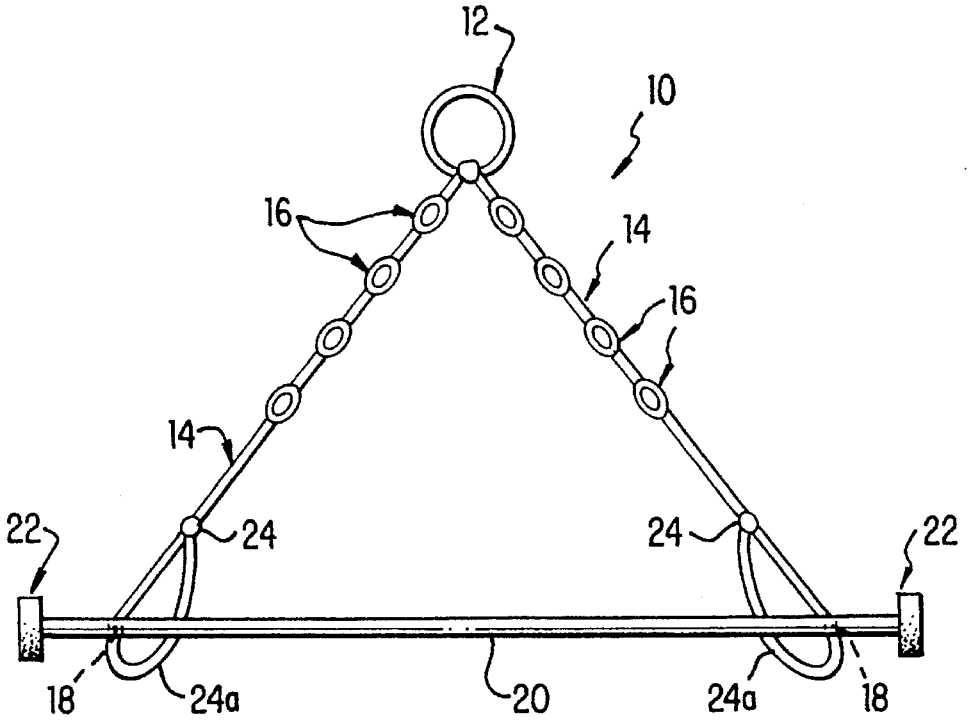
FIG. 1 shows a frontal view of the apparatus according to the invention.

With reference to FIG. 1, there is shown the apparatus, generally designated as 10 of the invention which comprises a flexible attachment loop 12 to which is secured a flexible member, or strand 14 which, preferably but not necessarily, may comprise a nylon rope. A series of generally equally spaced pressure applying nodules 16, which may be preferably, but not necessarily, formed by knots in the nylon rope 14, extend for part of the length of the nylon rope 14. The number of nodules 16 formed in the rope 14 may be varied, but preferably there would be at least three, or perhaps four, nodules adjacent to that part of the rope 14 to which is attached the attachment loop 12.

The nylon rope 14 passes through apertures 18 of a rigid bar 20, which may preferably be made of wood, so as to allow bar 20 to be attached to, or detached from, the nylon rope 14. Bar caps 22, which preferably may be made of a soft rubber, are attached to each end of the rigid bar 20. The two ends of nylon rope 14 which have been passed through the bores 18 of bar 20 are then looped in loops 24*a* and affixed to the rope 14 at fixing points 24 to secure bar 20 to the exercise apparatus 10.

Figure 2:
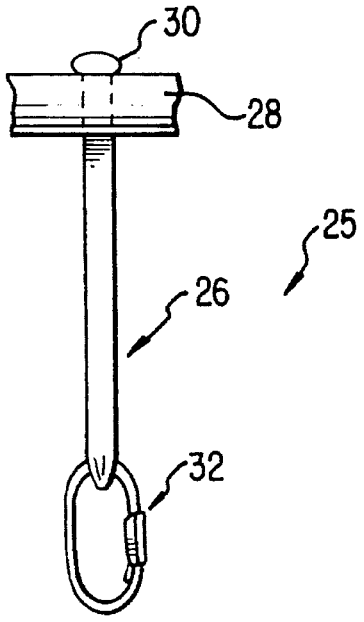
FIG. 2 shows one embodiment of an attachment device for use with the invention.

With reference to FIG. 2, an attachment device shown generally at 25 comprises a flexible member, or strand, 26 is formed into a loop and passed through a dowel 28. The strand 26 has at its one end thereof a knot 30 formed to retain the strand 26 with respect to the dowel. At the end of the strand 26 opposite the knot 30, a quick connect link 32 is also attached to the strand 26. The attachment device shown in FIG. 2 cooperates with the apparatus of FIG. 1 so that either attachment loop 12, in one configuration of the apparatus, or the two loops 24*a*, (without the bar 20), in another configuration, are passed through the quick connect link 32 for placing dowel 28 in a door jamb, for example.

In one use of the invention, the apparatus is used without the bar 20 being fastened to the strand 14 and both loops 24*a* are passed through the quick connect link 32 whereupon the dowel 26 is passed through a door jamb as will subsequently be described in several applications of the apparatus.

Figure 3:
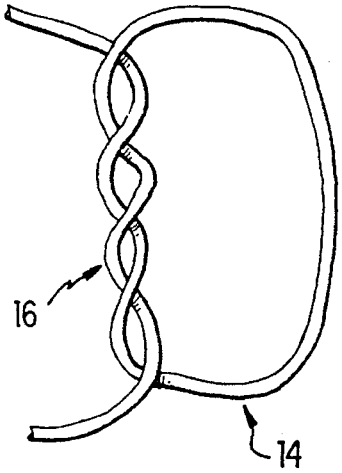
FIG. 3 shows how pressure applying nodules may preferably be formed in the flexible therapeutic device of the invention.

With reference to FIG. 3, the nodules 16 may preferably be formed in the strand 14 by several loops to thereby create a knot like structure, which, upon tightening of the strand 14, will present nodules approximately an inch to 2 inches in diameter. Alternatively, the nodules 16 may be formed of a separate material, such as wood, and would be affixed to the strand 14 like pearls on a string.

Figure 4A:
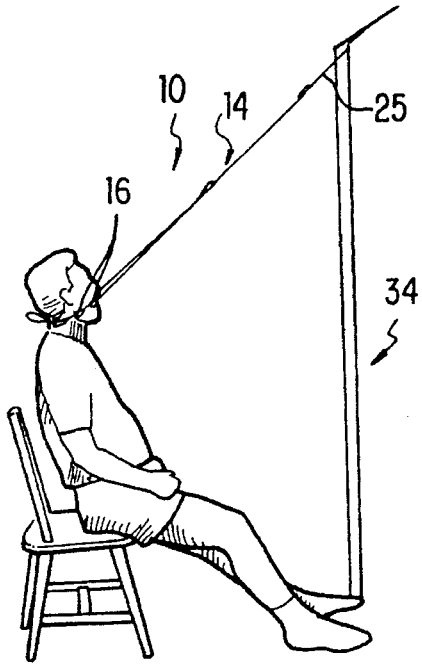
FIG. 4A illustrates the use of the invention in applying pressure to the neck and jaw muscles.

With reference now to FIG. 4A, a patient is shown as having one end of the apparatus 10, comprised of the nodules 16, looped around the neck and jaw while the other end of the apparatus is fastened, via attachment device 25 to a door jamb 34. The door jamb 34 provides a fixed and immovable attachment point. By leaning back against the strand 14, and placing it under tension and optionally rotating his head, the patient can apply localized pressure against the desired neck or jaw muscle groups. The length of the session depends upon the patient and may last only a few minutes depending upon the effects desired. Note that there is no need for the patient to exercise any muscular strength in the arm to apply pressure to the neck or jaw muscles. Furthermore, while FIG. 4A illustrates the use of the massage device of the invention which utilizes a chair on which the patient can rest, it is clearly within the scope of the invention to also have the patient standing and utilizing his leg muscles, generally the strongest in any muscle impaired person, to apply pressure against the neck or jaw muscle.

Figure 4B:
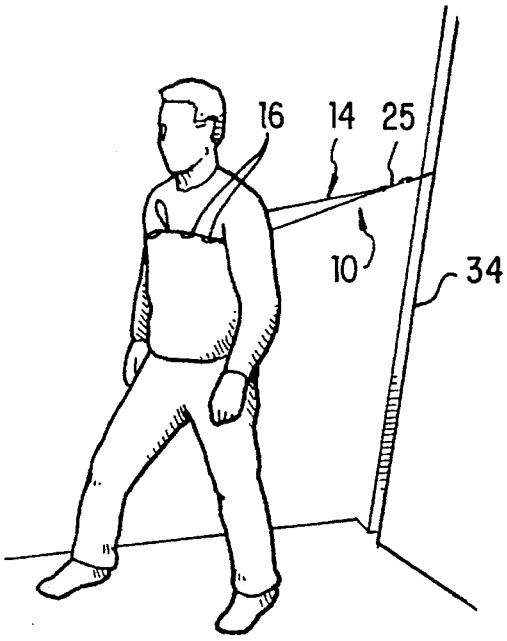
FIG. 4B illustrates the use of the invention in applying pressure to the chest muscles.

With reference to FIG. 4B, the device is again anchored in a door jamb 34 but is positioned so that the pressure applying nodules are stretched across the chest on a patient. In this case, like the example in FIG. 4A, body motion of the patient controlled largely by the leg muscles will apply the appropriate localized pressure to the area selected by the patient.

Figure 4C:
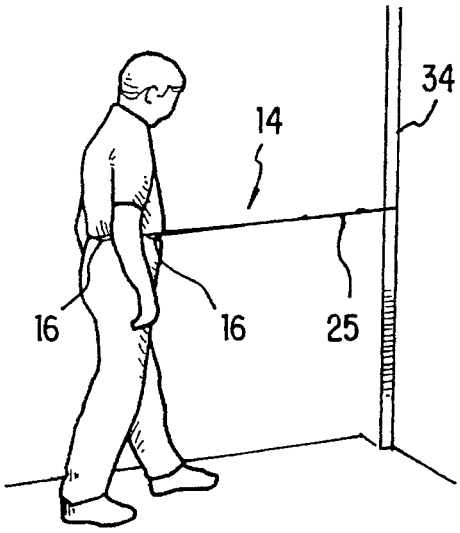
FIG. 4C illustrates use of the invention in applying pressure to the hip and back muscles of the human body.

With reference to FIG. 4C, the nodules are distributed across the back and the waist of a user and again, applying only leg force, localized pressure is applied to the back and waist muscles of the patient.

Figure 4D:
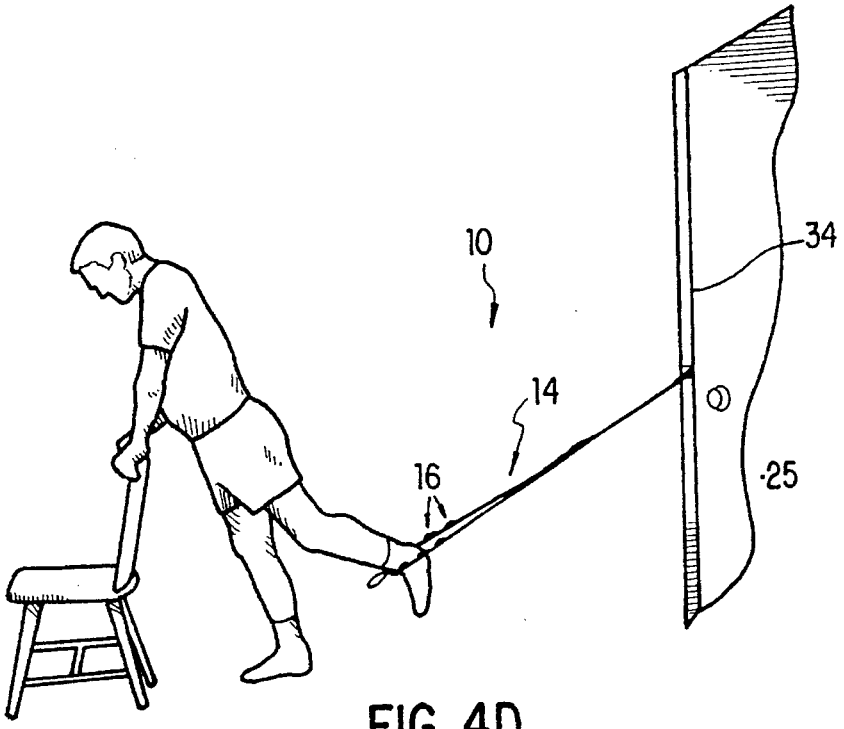
FIG. 4D illustrates the use of the invention to apply pressure to the foot and ankle muscles of a patient.

With respect to FIG. 4D, again the device 10 is anchored in a door jamb 34 and the pressure applying nodules 16 are wrapped around the foot and ankle of the patient. Again, exercise of the leg muscles to apply tension to strand 14 will apply localized pressure to the selected foot or ankle muscles of the patient.

Figure 5A:
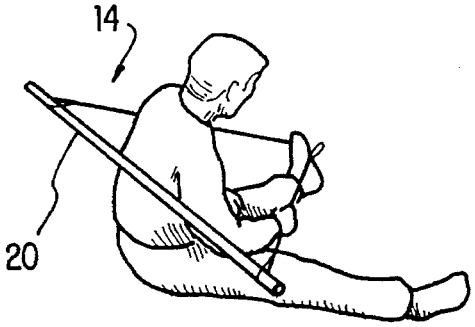
FIG. 5A illustrates the use of the invention to apply pressures to the back of the patient.

With reference to FIG. 5A, the device includes a bar 20, as shown in FIG. 1, and the pressure is applied, in this instance, to the back muscles of a patient through the bar 20, rather than the nodules 16. The device 10 is anchored at the end opposite bar 20 by the foot of the patient and the exertion of leg force with appropriate tilt of the bar 20 will apply pressure of the desired intensity at the location desired by the patient.

Figure 5B:
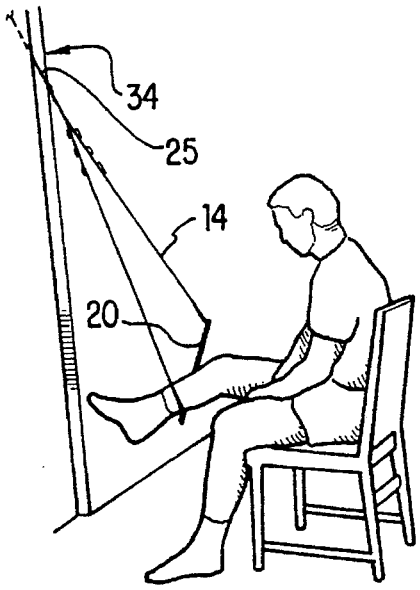
FIG. 5B illustrates use of the invention to apply pressure to the lower calf muscles of a patient.

With reference to FIG. 5B, the bar 20 is shown as being used to apply pressure to the lower calf muscles, again in an intensity, and in a location, as desired by the patient.

Figure 6A:
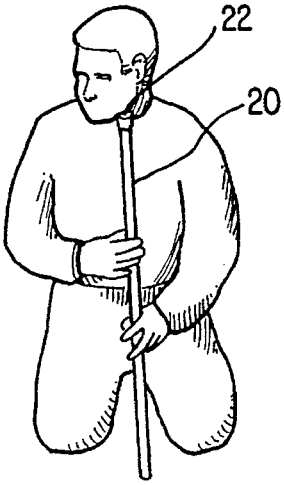
FIG. 6A illustrates use of the invention to apply pressure to the face of jaw muscles of a patient.

With reference to FIG. 6A, the illustration shows how the bar 20, by itself, may be used to apply pressure through the bar covers 22 to the jaw or neck area of a patient. The intensity of the pressure is controlled by the patient through the strength of the neck and upper back muscles.

Figure 6B:
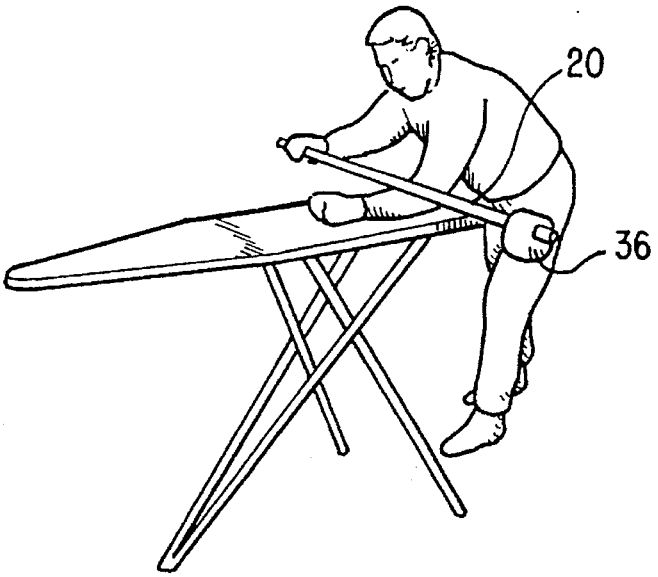
FIG. 6B illustrates the use of the invention to apply pressure to the forearm of a patient.

With reference to FIG. 6B, there is shown an embodiment of the invention in which the bar 20 is used with a counter weight 36 attached to at least one end thereof so as to facilitate use of the bar 20 in applying sufficient pressure through a localized area of the forearm of a patient. The pressure applying capabilities of the arm muscles of a patient are augmented by the counter weight 36.

Figure 7:
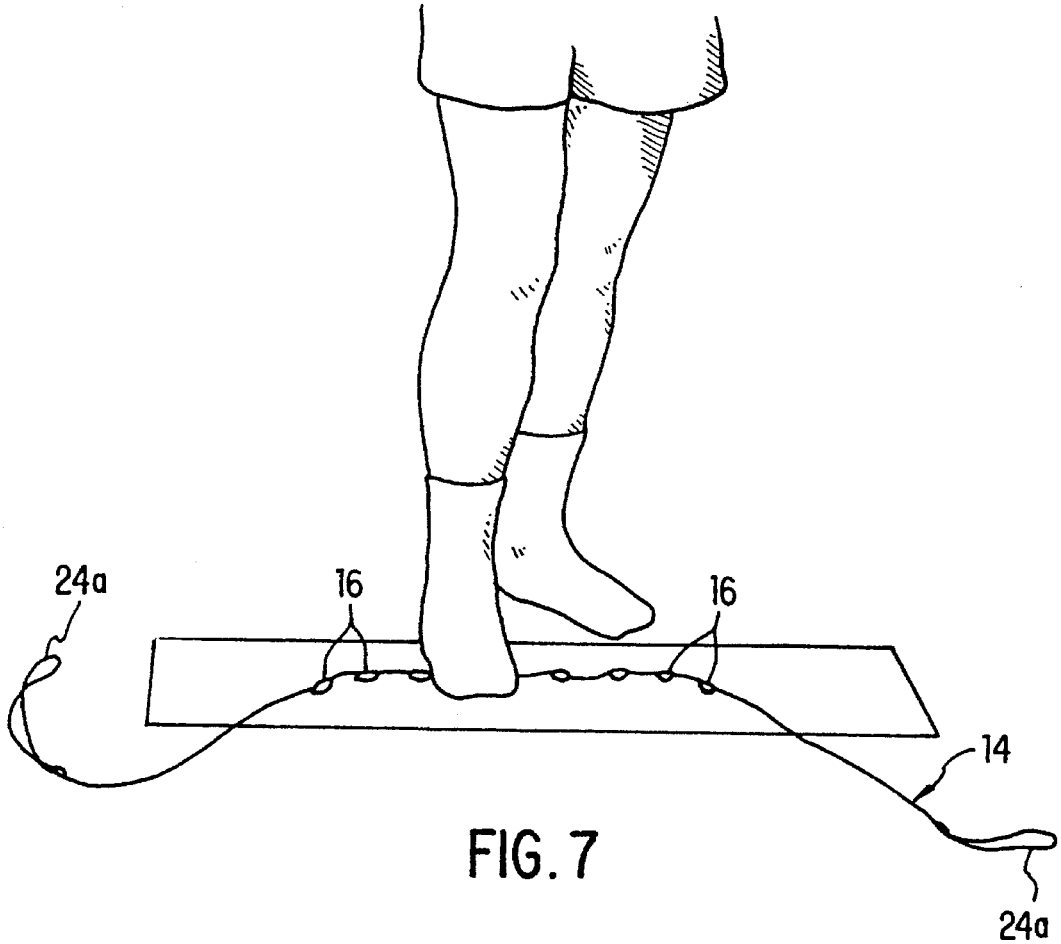
FIG. 7 illustrates use of a part of the invention to apply pressure to the foot and sole muscles of a patient.

With reference to FIG. 7, the strand 14 is placed on a floor surface and the nodules 16 are exposed to the sole of the foot of a patient. Again, the patient can control the intensity and location of the pressure applied by suitable exercise of the leg muscles. It will have been noted that the auto therapy device of the invention is flexible, easily portable, and can be used with minimum effort to apply therapeutic pressure to virtually any body part by the patient itself. The device is easily portable and can be used in many environments, including those outside the home, such as offices or hotels.

It is to be noted that the pressure applied by the nodules 16 reaches deep muscles while the bar is better suited to apply pressure to muscles located closer to the surface of the body.

While the invention has been particularly shown and described with reference to preferred embodiments thereof, it will be understood by those skilled in the art that the foregoing and other changes in form and detail may be made therein without parting from the spirit and scope of the invention, as set forth in the claims attached hereto.

What is claimed:

1. Method for the auto application of pressure to the desired muscles of the body comprising:

a) forming a flexible strand with pressure applying nodules along the flexible strand, wherein the pressure applying nodules are formed by knots in the strand;

b) placing the pressure applying nodules directly in contact with the body in the area of the muscles; and c) applying a substantially static force to the strand for causing the pressure applying nodules to apply pressure to the muscles at localized points.

2. Method according to claim 1, wherein the force applied places the strand under tension.

3. Method according to claim 1, further including the step of attaching the strand to an immovable point.

* * * * *